US006474208B1

(12) United States Patent
Bilstein et al.

(10) Patent No.: US 6,474,208 B1
(45) Date of Patent: Nov. 5, 2002

(54) CUTTING DEVICE WITH DETACHABLE CUTTER HEAD FOR CUTTING SHEET MATERIAL LENGTH-WISE

(75) Inventors: Willi Bilstein, Overath (DE); Ingo Picker, Much (DE)

(73) Assignee: Wilhelm Bilstein KG, Spezialfabrik fur Rundmesser und Plattenventile, Overath (DE)

( * ) Notice: Subject to any disclaimer, the term of this patent is extended or adjusted under 35 U.S.C. 154(b) by 0 days.

(21) Appl. No.: 09/582,712

(22) PCT Filed: Oct. 23, 1999

(86) PCT No.: PCT/EP99/08045

§ 371 (c)(1),
(2), (4) Date: Jun. 30, 2000

(87) PCT Pub. No.: WO00/25994

PCT Pub. Date: May 11, 2000

(30) Foreign Application Priority Data

Oct. 30, 1998 (DE) ..... 198 50 043

(51) Int. Cl.[7] ..... B26D 1/143
(52) U.S. Cl. ..... 83/481; 83/504; 83/698.41
(58) Field of Search ..... 83/497, 498, 500, 83/496, 508.2, 501, 502, 425.4, 698.41, 504, 481

(56) References Cited

U.S. PATENT DOCUMENTS

| | | | | | |
|---|---|---|---|---|---|
| 3,185,010 | A | * | 5/1965 | Printz et al. | 83/482 |
| 3,186,282 | A | * | 6/1965 | Waterhouse | |
| 3,651,728 | A | * | 3/1972 | Young | 83/474 |
| 4,092,886 | A | * | 6/1978 | Nowisch | |
| 4,438,673 | A | * | 3/1984 | Noffke et al. | |
| 5,058,475 | A | * | 10/1991 | Tidland et al. | 83/481 |
| 5,127,295 | A | * | 7/1992 | Hax et al. | |
| 5,370,026 | A | * | 12/1994 | Cavagna | |
| 5,373,766 | A | | 12/1994 | Ranly et al. | |

FOREIGN PATENT DOCUMENTS

| | | |
|---|---|---|
| DE | 182 115 | 9/1903 |
| DE | 298 10785 | 9/1998 |
| EP | 0 655 302 | 5/1995 |

* cited by examiner

*Primary Examiner*—Kenneth E. Peterson
(74) *Attorney, Agent, or Firm*—Venable; Norman N. Kunitz

(57) ABSTRACT

The device for cutting sheet material length-wise includes a knife holder assembly which can be linked to a cutter bar. The knife holder assembly has a support body and a cutter head which carried a circular cutting knife and which can be adjusted vertically in relation to the support body. The knife holder assembly also has a connecting plug assembly for connecting the support body to the cutter head. The direction of connection extends in the plane of the circular cutting knife.

3 Claims, 3 Drawing Sheets

Figure 1:
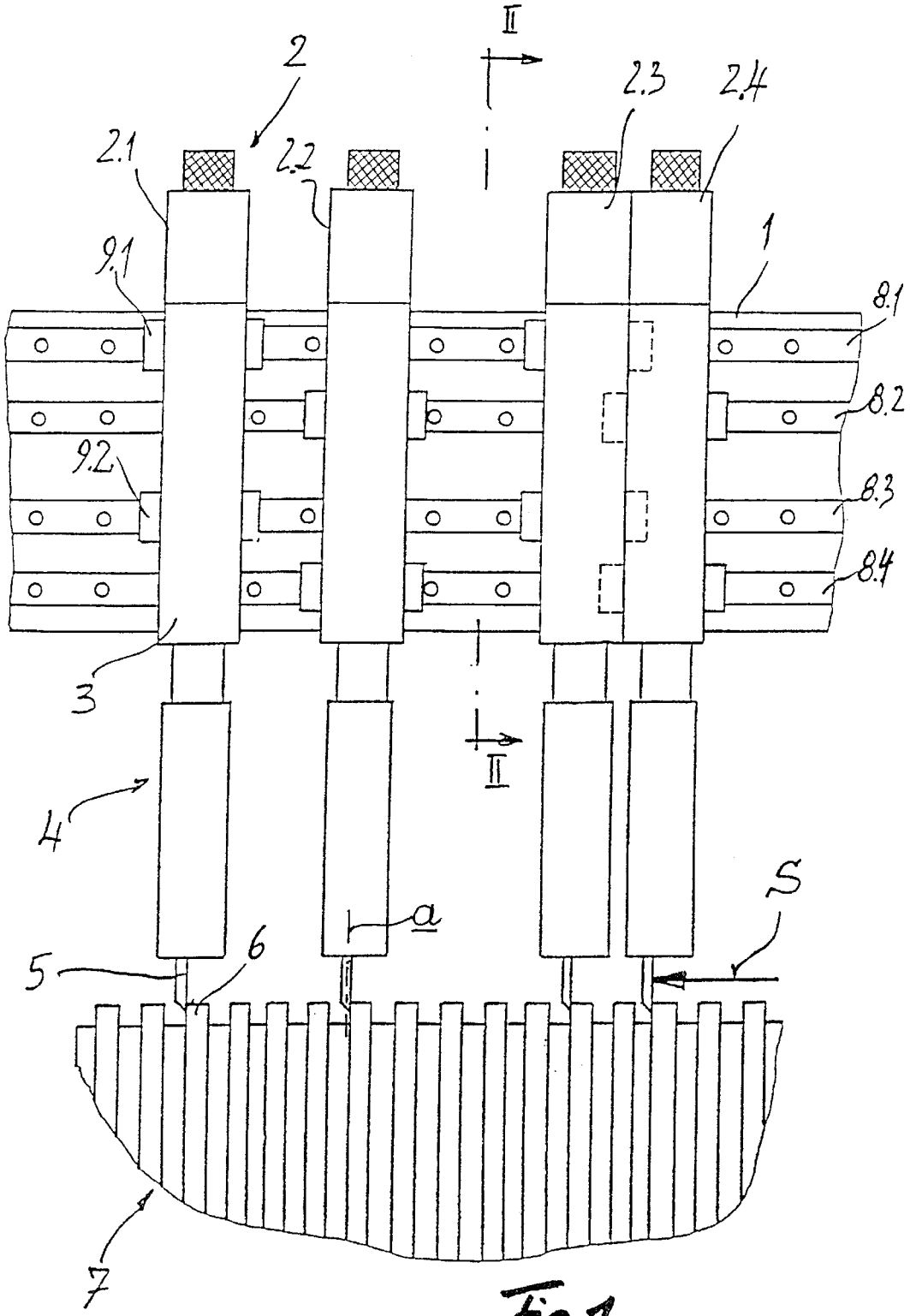

CUTTING DEVICE WITH DETACHABLE CUTTER HEAD FOR CUTTING SHEET MATERIAL LENGTH-WISE

Several knife holders attached to a cutter bar are used for cutting sheet material lengthwise. The individual knife holders essentially comprise one controllable lowering device, on which a circular cutting knife is positioned on a cutter head, such that it can rotate. The individual knife holders are mounted detachably on the cutter bar, so that the desired cutting widths can be adjusted by adjusting the mutual distances between neighboring knife holders. The circular cutting knives wear out over time and must therefore be replaced from time to time to maintain the cutting quality. The circular cutting knife, which is attached with the aid of a ring nut to the cutter head, can be pulled off the cutter head once the ring nut is unscrewed and can be replaced with a new circular cutting knife. However, these operations are time consuming and, in particular, are difficult to carry out when cutting narrow material sheets. With extremely narrow cutting widths, the required access to the ring nut does not even exist, so that the knife holder must be removed altogether.

It is the object of the invention to create a device for cutting material sheets of the aforementioned type in lengthwise direction, which device permits an easy replacement of damaged or worn circular cutting knives.

This object is solved according to the invention with a device for cutting material sheets lengthwise, which device contains a knife holder that can be attached to a cutter bar. The knife holder essentially consists of a support body and a cutter head that is provided with a circular cutting knife. The cutter head is adjustable in vertical and horizontal direction, relative to the support body, and is provided with an interlocking, plug-type connector for connecting the support body to the cutter head and/or the cutter bar. The plug-in direction of this connector extends in the plane for the circular cutting knife.

With a knife holder designed in this way, it is possible to replace a damaged or worn circular cutting knife without having to remove the knife holder from the cutter bar, even if the individual knife holders are arranged tightly adjoining on the cutter bar. The specified position of the knife holder, relative to the adjacent knife holders, is thus maintained. Following the release of the interlocking, the cutter head as a whole can be pulled off the support body toward the front. In place of the cutter head with the damaged circular cutting knife, a cutter head with a new circular cutting knife is then fitted onto the support body and is interlocked with this body, so that the full function is restored once more.

The solution according to the invention can also be used with a device for cutting material sheets lengthwise, for which the knife holders are not connected directly to the cutter bar, but to an adapter slide that can be moved along the cutter bar and can be locked in place thereon. With a device of this type, a corresponding plug-type connector between support body and adapter slide can be provided in addition to or in place of the plug-type connector between cutter head and support body. Given a system of this type and following the release of the interlocked plug-in connection, the complete knife holder is lifted in upward direction off the adapter slide and is replaced by a new knife holder. This occurs without a change in the positioning, relative to the neighboring knife holders, which is predetermined by the positioning of the adapter slide. A measure of this type is required, in particular, if the standard pneumatic adjustment device in the support body for the vertical movement of the cutter head no longer operates without problems or is not operational at all, for example as a result of leaks in the piston-cylinder system.

One preferred embodiment of the invention provides that the plug-type connector is formed by a guide pin on the one part and a corresponding receptacle for the guide pin on the other part, as well as the coordinated form-fitting surfaces on both parts. The preferably cylindrical guide pin can be bought cheaply as prefabricated, semi-finished product. Accordingly, the hole for the guide pin is simply a corresponding mating bore. As a result of this arrangement of the coordinated form-fitting surfaces, which function to tension the two parts against each other via the interlocking, it is ensured that the two parts are rigidly connected and that the breakdown torque as well as the torque, introduced by the cutting forces, are reliably absorbed.

One advantageous embodiment of the invention furthermore provides that the interlocking connection is formed by a screw tensioning the guide pin against the hole. An interlocking connection of this type is easy to produce since the guide pin is provided with an axial thread bore. In addition, it has the advantage that the interlocking is also accessible in plug-in direction. In that case, the screw can be designed, for example, as hexagon socket screw, so that it is easy to create the interlocking connection by using an appropriate screwdriver.

According to one preferred embodiment of the invention, the coordinated formlocking surfaces are formed by a cross bolt on the guide pin and a recess in the receiving mating bore.

Another embodiment of the invention provides that the form-locking surfaces are formed by coordinated wedge-shaped surfaces that face each other. This embodiment has the advantage of providing relatively large, contacting surface areas, so that the permissible surface pressures are not exceeded, even for high pressing forces. Another advantage of this embodiment having wedge-shaped surfaces is that there is no play in plug-type connector because the surfaces are tensioned against each other. The embodiment can also be used in conjunction with the previously described cross bolts.

The invention is explained in further detail in the following with the aid of schematic drawings of exemplary embodiments, which show in:

FIG. 1 A frontal view of a cutter bar with several knife holders.

Figure 2:
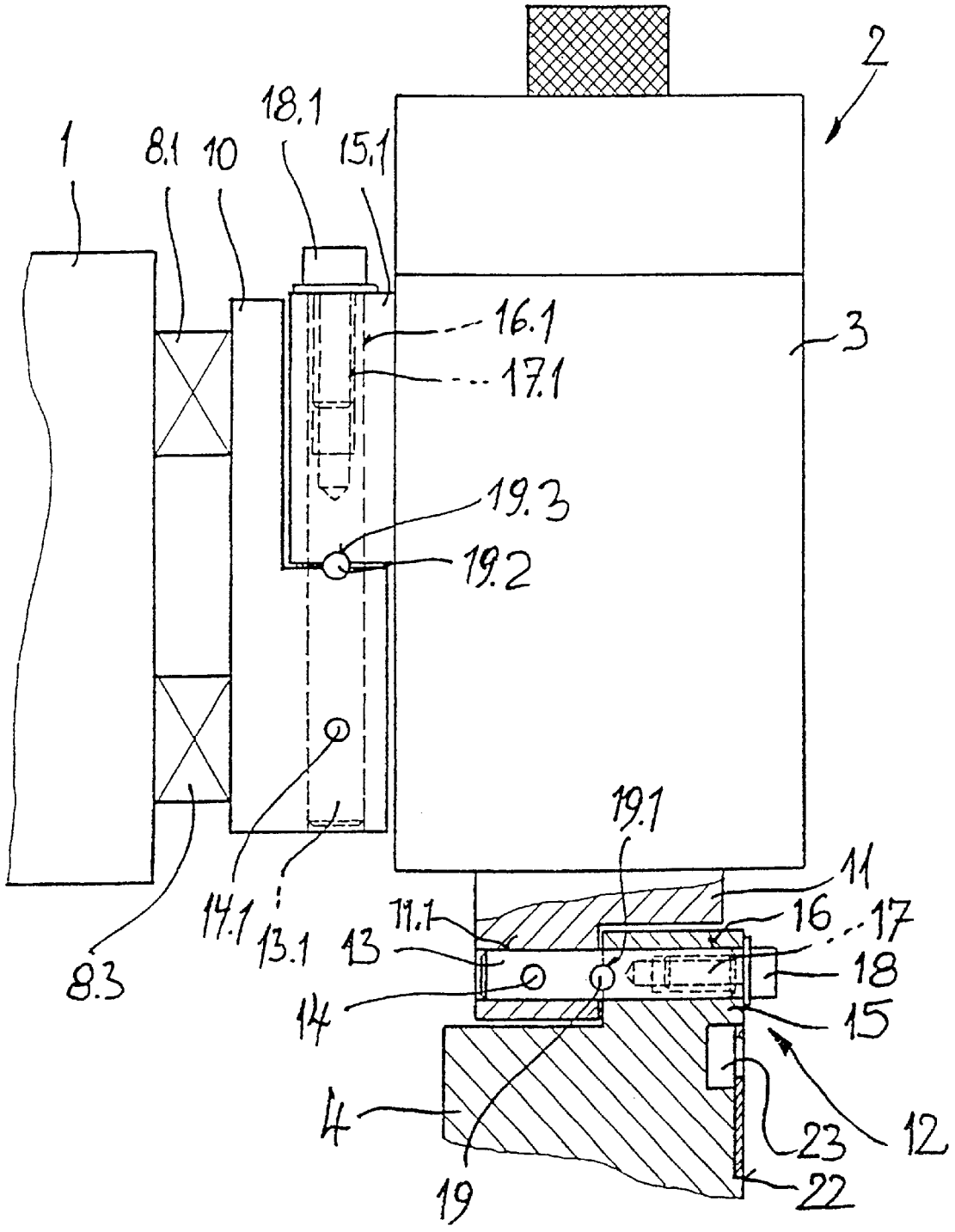

FIG. 2 A view from the side of a support body for a knife holder.

Figure 3:
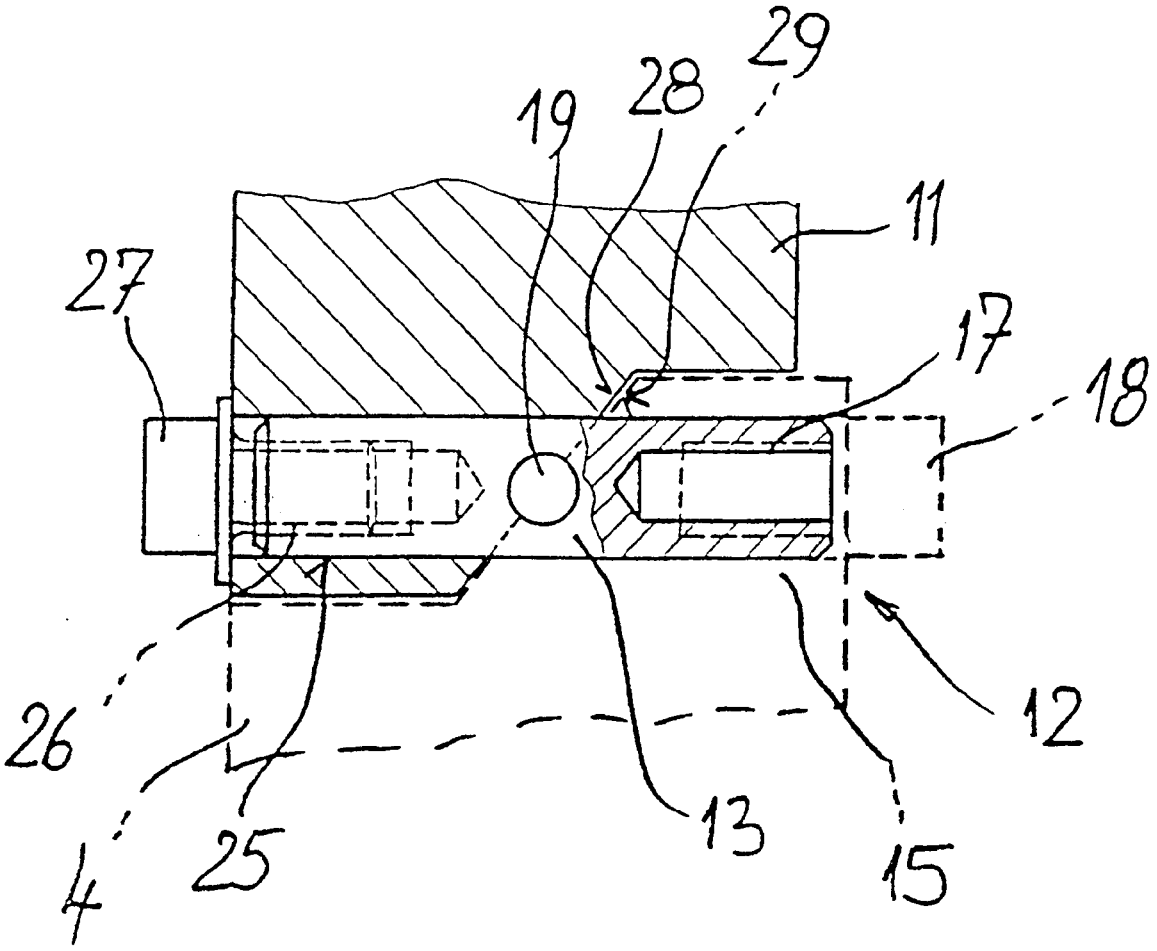

FIG. 3 A modified embodiment of the plug-type connector.

The frontal view according to FIG. 1 shows a cutter bar 1 of a device for cutting material sheets in lengthwise direction. Four knife holders 2.1, 2.2, 2.3 and 2.4 are attached to this cutter bar. The knife holders 2 comprise respectively one support body 3, on which a cutter head 4 with freely rotating circular cutting knife 5 is mounted, such that it can be lifted and lowered in vertical direction, which support body can also be pulled out horizontally. In the illustration shown herein, a hand protector furthermore covers the cutter head 4, so that only the lower cutting region of the circular cutting knife 5 is visible. Following the horizontal adjustment, the circular cutting knife 5 operates against cutting rings 6, which are mounted on a knife shaft 7 at a distance to each other.

The individual knife holders 2 can be displaced relative to each other along the cutter bar 1 in horizontal direction and can be secured relative to each other at predetermined distances. For this, four parallel guide bars 8.1, 8.2, 8.3 and 8.4 are provided at a distance to each other on the cutter bar 1. On these guide bars, the support bodies 3 of knife holders 2 are respectively positioned via an adapter slide 10 (FIG. 2), such that they can be moved and locked in place. Each adapter slide 10 is provided with a guide carriage 9.1 and 9.2, such that the adapter slides 10 of neighboring knife holders are guided alternately on an upper pair of guide bars 8.1 and 8.3 and, respectively, on a lower pair of guide bars 8.2 and 8.4. Thus, for example, the adapter slide 10 of the knife holder 2.1 glides on the guide bars 8.1 and 8.3, whereas the adapter slide 10 of the neighboring knife holder 2.2 glides on the guide bars 8.2 and 8.4. As a result, the lever arm formed respectively by the guide bars 8.1, 8.2, 8.3 and 8.4 with the coordinated parts of adapter slide 10, which serves to absorb the cutting forces (arrow S) effective in crosswise direction to the cutting plane of circular cutting knife 5, is enlarged correspondingly. The complete arrangement is thus more rigid, so that any defects in the cutting quality are avoided.

As shown for the knife holders 2.3 and 2.4, this arrangement offers the option of positioning the knife holders directly adjacent to each other since the guide slides 9.1 and 9.2 for structural reasons have a wider width than the maximum width of the support bodies 3 for knife holders 2. This is the case because the adapter slides 10, with their respective ends of guide slides 9 that project over the width of the support bodies 3, can "move underneath" the support body 3 of the neighboring knife holder 2.

With this embodiment, the knife holders 2 that are guided along and held in place on the cutter bar with the aid of adapter slides 10 can be secured with the usual narrow spacing on the cutter bar 1 since the adapter slides 10 are advantageously held in place on the cutter bar 1 with ball bearing guides, which accordingly are embodied to be wider than the support bodies 3 of knife holders 2.

The view from the side according to FIG. 2 shows essentially only the support body 3 of a knife holder 2 with the herein relevant connections to the cutter head 4 on the one side and an adapter slide 10 on the other side.

The support body 3 is provided with an adjustment element 11, which is guided perpendicular inside the support body 3, as well as with a pneumatic adjustment drive of a known design for the downward movement, which is not shown further herein. The adjustment drive furthermore has a resetting spring for the upward movement after the pressure is removed from the adjustment drive.

The cutter head 4 is connected via a plug-type connector 12 to the adjustment element 11. The plug-type connector 12 for the exemplary embodiment shown herein comprises a guide pin 13 with cylindrical cross-section, which is inserted into a mating bore 11.1 on the adjustment element 11 and is secured with a bolt 14 on the adjustment element 11. The direction of insertion of the guide pin 13 (plug-in direction) lies in the cutting knife plane a shown in FIG. 1 for one of the cutting knives 5.

The cutter head 4 has an extension, which serves a receptacle 15 for the free end of guide pin 13 and is provided with a mating bore 16. The free length of guide pin 13 is somewhat shorter than the length of the mating bore 16 and is provided with an axial tapped hole 17. For the interlocking, a hexagon socket screw 18 can be screwed into this tapped hole 17, through which the cutter head 4 with its receptacle 15 can be tensioned against the guide pin 13 in axial direction.

In order to achieve an exact positioning and simultaneously create a non-rotating plug-type connection, a cross bolt 19 is arranged on the guide pin 13, in the area of the surfaces of adjustment element 11 and receptacle 15, which face each other. A corresponding semi-cylindrical recess 19.1 on the receptacle 15 is assigned to this cross bolt. If the screw 18, which serves as interlocking device, is used to tension the cutter head 4, then the semi-cylindrical recess 19.1 on the receptacle 15 is pressed against the cylindrical outside surface of cross bolt 19, wherein the contacting surfaces of semicylindrical cylindrical recess 19.1 and cross bolt 19 form coordinated form-fitting surfaces. The form-fitting connection between cutter head 4 and adjustment element 11 of support body 3, which is established in this way via the plug-type connector 12, is sufficient to reliably absorb the cutting forces generated during the operation (arrow S in FIG. 1).

The screw 18 that functions as interlocking device is unscrewed in order to replace a cutter head 4. Even if the individual knife holders 2 are positioned tightly sideby-side, as shown in FIG. 1, a cutter head 4 can be pulled toward the front in the direction of arrow 21. In order to provide easier access for this operation, an undercut recess 23 is provided on the forward pointing frontal surface 22 of cutter head 4, into which a hook-shaped removal tool can be inserted.

A knife holder 2, designed in this way, can be connected detachably to the cutter bar 1, in the standard way via a prism-shaped clamping rail on the cutter bar 1 on one side and a corresponding clamping part on the support body 3.

With the exemplary embodiment shown herein, for which the support body 3 can be connected via an adapter slide 10 to the cutter bar 1, a correspondingly configured plug-type connector 24 is also provided for the connection between support body 3 and adapter slide 10. This plug-type connector is configured in the same way as the previously described plug-type connector between adjustment element 11 and cutter head 4. With the adapter slide 10, a guide pin 13.1 is[1] via a cross pin 14.1, a partial length of which projects freely upward from the adapter slide 10.

[1] Note: This sentence is complete.

The support body 3 is provided with a corresponding receptacle 15.1, which in turn contains a mating bore 16.1, so that the support body 3 can be fitted onto the free end of guide pin 13.1.

A screw 18.1 that is screwed into an inside thread 17.1 in turn serves as interlocking device. The form-fitting surfaces are again provided by a cylindrical cross bolt 19.2, with which the receptacle 15.1 makes contact in a form-fitting manner with a cylindrical surface 19.3.

With this type of interlocking connection, the screw 18.1 is also initially unscrewed to remove the complete knife holder 2. Following this, the complete knife holder 2 can then be pulled off in upward direction.

FIG. 3 shows another exemplary embodiment for mounting the guide pin, for example on the adjustment element 11. With this type of design, a guide pin 13 is used, which is provided on both ends with an axial inside thread 17 and 26. The guide pin is furthermore provided in the center region with a cross bolt 19. The guide pin 13 is inserted into a corresponding mating bore 25 on the adjustment element 11 and, with the aid of a fastening screw 27, is tensioned tightly with the adjustment element 11 against the cross bolt 19. In this case as well, corresponding semi-cylindrical contact surfaces are provided on the adjustment element 11. The cutter head 4 (only indicated herein) is then fitted onto the free end of guide pin 13— as described with the aid of FIG. 2—and is tensioned in the previously described manner. With this type of design, it is also possible to remove the cutter head 4 if the fastening screw 27 is unscrewed in place of the screw 18. Thus, access is provided from both sides.

With the exemplary embodiments described herein with the aid of FIG. 2 and FIG. 3, the form-fitting surface between the two parts that are connected with the plug-type connector can be formed by the surfaces of the two parts that face each other instead of the cross bolt 19. For the embodiment according to FIG. 3, for example, a recess with larger dimensions can be provided in the area of the cross bolt in place of the only schematically indicated recess 15 in cutter head 4 and the facing surfaces 28 and 29 can be configured as wedge-shaped surfaces. Thus, if the two parts are tensioned against each other with the screw 18, the surfaces 28 and 29 are not only pressed against each other, but are also displaced against each other within the range of a possible play, so as to eliminate the play between the free end of the guide pin and the associated mating bore in the receptacle 15.

What is claimed is:

1. A device for cutting material sheets lengthwise, comprising (a) a knife holder including
  (1) a support body;
  (2) an adjustment element movably guided in said support body and having a first bore; and
  (3) a cutter head having a second bore being in an end-to-end alignment with said first bore; said cutter head being a component separate from said adjustment element;

(b) means for mounting said support body on a cutter bar;

(c) a circular cutting knife rotatably mounted on said cutter head and defining a cutting knife plane; and (d) a connecting plug assembly including
  (1) a guide pin positioned in the end-to-end aligned first and second bores for connecting said adjustment element with said cutter head; said first and second bores defining a plug-in direction for said guide pin; said plug-in direction lying in said cutting knife plane; and
  (2) a locking component having a tightened state and a released state; in said tightened state the locking component engaging said guide pin and clamping said adjustment element and said cutter head to one another through said guide pin; in said released state of said locking component said cutter head being removable from said adjustment element;
  (3) a first surface forming part of said adjustment element; and
  (4) a second surface forming part of said cutter head; said first and second surfaces facing one another; in said tightened state said locking component clamping said first and second surfaces to one another.

2. The device as defined in claim 1, wherein said second surface has a shape conforming to said first surface; said first and second surfaces being oriented obliquely to said plug-in direction; in said tightened state said locking component clamping said first and second surfaces to one another in said plug-in direction.

3. A device for cutting material sheets lengthwise, comprising (a) a knife holder including
  (1) a support body;
  (2) an adjustment element movably guided in said support body and having a first bore; and
  (3) a cutter head having a second bore being in an end-to-end alignment with said first bore; said cutter head being a component separate from said adjustment element;

(b) means for mounting said support body on a cutter bar;

(c) a circular cutting knife rotatably mounted on said cutter head and defining a cutting knife plane; and (d) a connecting plug assembly including
  (1) a guide pin positioned in the end-to-end aligned first and second bores for connecting said adjustment element with said cutter head; said first and second bores defining a plug-in direction for said guide pin; said plug-in direction lying in said cutting knife plane;
  (2) a cross bolt on said guide pin;
  (3) a locking component having a tightened state and a released state; in said tightened state the locking component engaging said guide pin and clamping said adjustment element and said cutter head to one another through said guide pin; in said released state of said locking component said cutter head being removable from said adjustment element;
  (4) a first surface forming part of a circumferential surface portion of said cross bolt; and
  (5) a second surface forming part of said cutter head and having a shape conforming to said first surface; said first and second surfaces facing one another; in said tightened stat said locking component clamping said first and second surfaces to one another.

* * * * *